United States Patent [19]

Croley

[11] 4,397,406

[45] Aug. 9, 1983

[54] KNOCKED-DOWN DRUM-LIKE FIBERBOARD CONTAINER FOR BULK MATERIAL WITH FUNNEL-LIKE DISPENSING BOTTOM

[75] Inventor: Thomas E. Croley, Worthington, Ohio

[73] Assignee: Willamette Industries, Inc., Delaware, Ohio

[21] Appl. No.: 277,970

[22] Filed: Jun. 26, 1981

[51] Int. Cl.[3] ..... B65D 35/56

[52] U.S. Cl. ..... 222/105; 222/185; 222/460; 229/17 B

[58] Field of Search ..... 222/185, 181, 173, 460–462, 222/564, 81, 88, 105, 183, 180, 92, 80; 229/23 D, 23 BT, 23 A, 17 B, 17 R; 220/403, 404

[56] References Cited

U.S. PATENT DOCUMENTS 3,348,738 10/1967 Hertlein ..... 222/88
4,120,420 10/1978 Dirksing ..... 222/460
4,240,565 12/1980 Croley ..... 222/105

FOREIGN PATENT DOCUMENTS 1214017 11/1970 United Kingdom .

*Primary Examiner*—Kenneth W. Noland
*Attorney, Agent, or Firm*—William V. Miller

[57] ABSTRACT

A drum-like container of fiberboard or similar material supplied in flat knocked-down form and adapted to be set up as a multi-sided receptacle of polygonal transverse cross-section. It is provided with a funnel-like dispensing bottom which is also supplied in knocked-down form and consists of two sections, namely, a peripheral support wall section and a material-directing section. The set-up support wall section within the receptacle will be of similar multi-sided arrangement to fit therein. The set-up material-directing section will be of funnel-like form and when resting on the support section within the receptacle will direct the receptacle.

7 Claims, 12 Drawing Figures

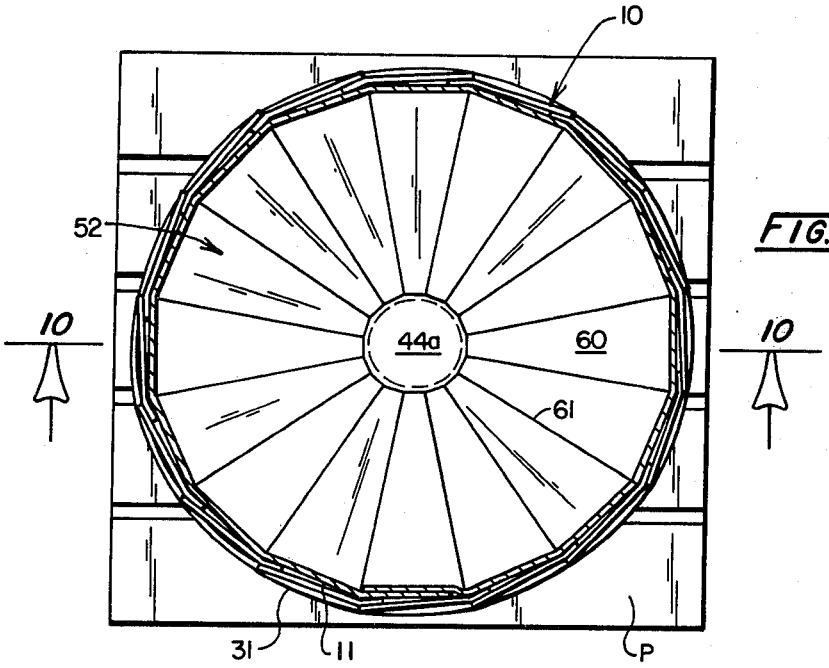
FIG. 2
FIG. 4
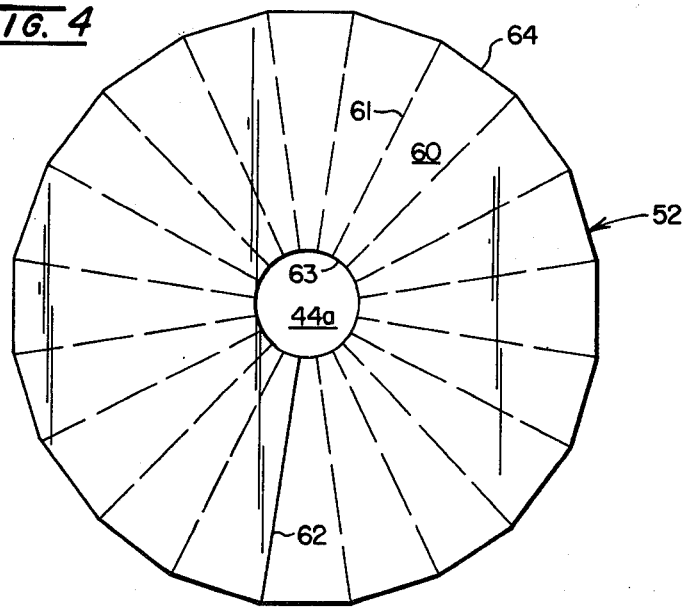

KNOCKED-DOWN DRUM-LIKE FIBERBOARD CONTAINER FOR BULK MATERIAL WITH FUNNEL-LIKE DISPENSING BOTTOM

BACKGROUND, PRIOR ART AND BRIEF DESCRIPTION OF THE INVENTION

This invention relates to a multi-sided drum-like fiberboard container of the general type disclosed in my prior U.S. Pat. No. 4,240,565. That patent discloses a container made of fiberboard or the like which is supplied in knocked-down form and which when set-up is of multi-sided polygonal drum-like form. It includes a bottom structure which is also provided in knocked-down form but is set-up within the polygonal container to provide a funnel-like material-directing bottom.

The funnel-like bottom structure of that patent is made up of a plurality of wedge-shaped insert sections, corresponding in number to the number of sides of the container, which are also supplied in knocked-down form. The use of this large number of sections results in great strength which is very desirable in containers for the heavier materials. However, in containers for light to medium weight materials this great strength is not necessary and it is possible to use a bottom structure which does not consist of such a large number of parts which result in increased costs in material to form them and in labor costs to set them up and assemble them in the container.

The present invention provides a funnel-like bottom structure which is supplied as only two knocked-down sections, one a support section and the other a material-directing section. The support section will have the same number of sides as the polygonal body of the container and when disposed therein in upright set-up condition will contact the corresponding walls of the container body. The material-directing section will be of funnel-like form when in set-up condition within the container body and will have its upper end resting on the upper portion of the support wall and inclined material-directing wall sections of substantially triangular form converging at a lower central dispensing opening. These two sections can be formed at relatively low cost, can be set-up expeditiously and will have sufficient strength for the intended use.

The references cited against said U.S. patent included British Pat. No. 1,214,017 which disclosed a one-piece knocked-down blank which could be set-up in a container as a false funnel-like bottom. However, this was difficult and expensive to form from a single blank requiring much slitting and scoring, difficult to fold in setting it up, requiring alternate back-folding of hinged walls or flaps, and when finally set-up, did not have total perimeter strength.

The present invention overcomes all these difficulties in that it can be formed from a blank in a simple and less costly manner, can be set-up expeditiously with a minimum of labor and when set-up, the material-directing section will have complete perimeter support by the support section.

BRIEF DESCRIPTION OF THE DRAWINGS

The best mode contemplated in carrying out this invention is illustrated in the accompanying drawings in which:

FIG. 2 is a horizontal sectional view taken along line 2—2 of FIG. 1;

FIG. 4 is a plan view of the unfolded blank used in forming the material-directing section of the funnel-like bottom of this invention;

DETAILED DESCRIPTION OF THE INVENTION

Figure 1:
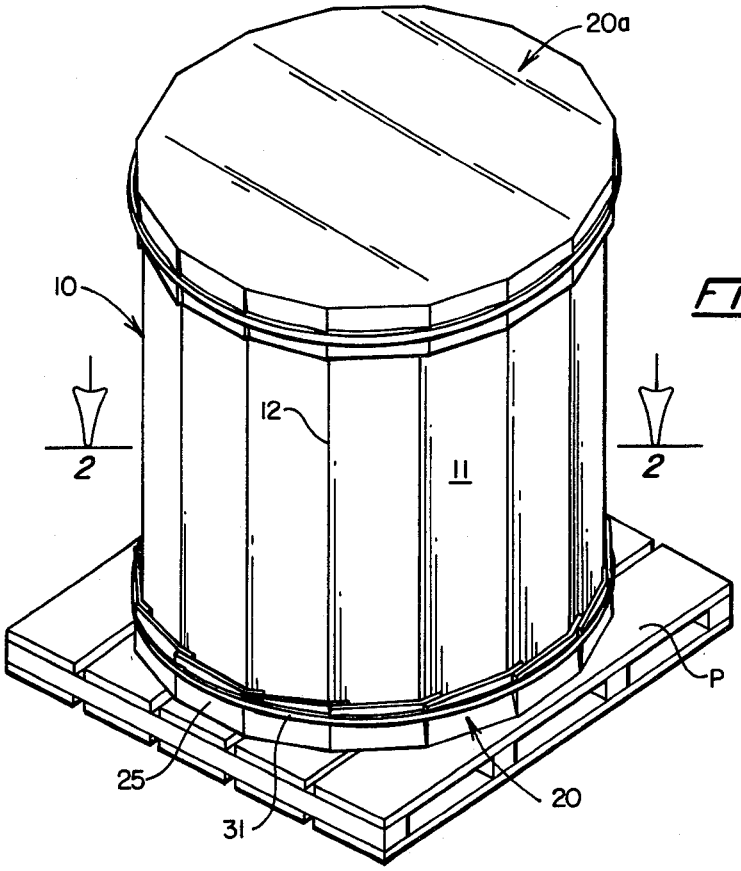
FIG. 1 is a perspective view of the container assembly to which this invention is applied.

With reference to the drawings and particularly to FIG. 1, there is shown generally a fiberboard container assembly of the type described in my U.S. Pat. No. 4,240,565. As described in my patent, the container assembly includes a drum-like container body 10 of multi-sided polygonal form which is composed of a series of vertical panels 11 hinged together at 12 sixteen panels being given as an example. The body is supplied in flat knocked-down form and is set up on a tray-like bottom closure element 20 which includes a flat polygonal disc-like bottom 21 (FIGS. 10 and 11) and hinged attached flanges 25. This bottom closure is also formed of fiberboard or the like and the flanges 25 are turned upwardly so that they overlap the panels 11 and are secured in that position such as by retaining band 31. The flanges 25 are arranged similar to panels 11 and in corresponding number to properly overlap them and cooperate therewith. The lower ends of the panels 11 are provided with inwardly-turned flanges 14 which rest on the flat bottom 21 to which they are secured and both these members may be secured to a pallet, indicated generally at P, by fasteners in the form of nails or staples which are passed downwardly through the flanges 14 and bottom 21 into the pallet.

Figure 3:
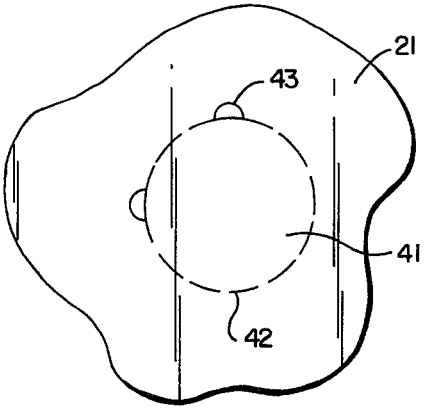
FIG. 3 is a plan view showing a displaceable opening-forming part in the flat bottom disc.
Figure 11:
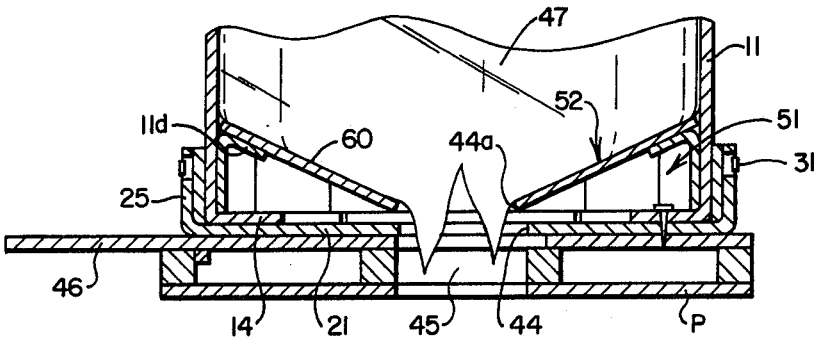
FIG. 11 is a similar but partial sectional view showing the bottom unsealed for dispensing.

In order to dispense material through the bottom of the container, a central opening can be provided in the center of the flat disc-like bottom 21 by means of a downwardly-displaceable central disc 41. Disc 41 (FIG. 3) is formed by a circular perforation 42 with at least two semi-circular cuts at angularly spaced positions to provide pull-out tabs 43. Disc 41 is normally in the plane of flat bottom 21 but can be displaced downwardly by engaging a tool with the tabs 43 to provide the central bottom opening 44 (FIG. 11).

Figure 10:
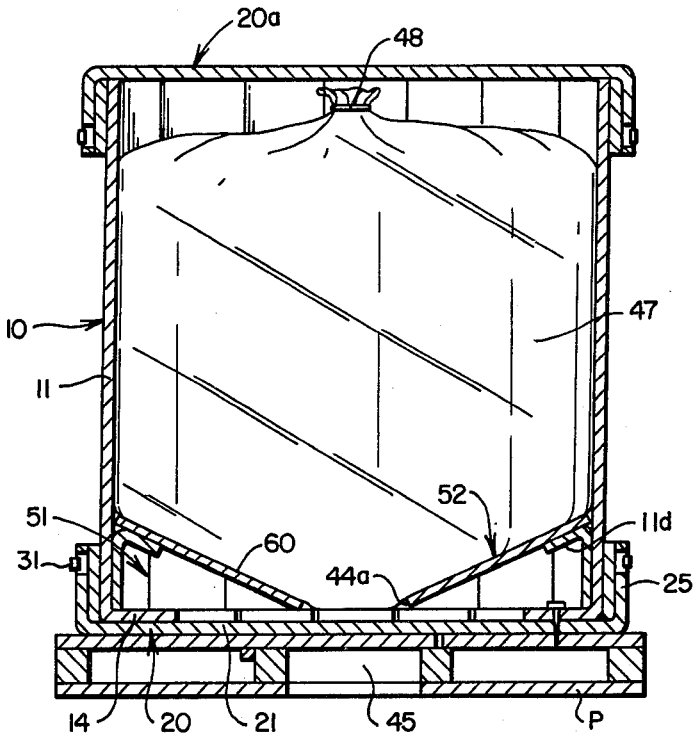
FIG. 10 is a vertical sectional view taken along line 10—10 of FIG. 2 showing the container filled and the bottom sealed.

To cooperate with this opening 44, the pallet P is provided with a central opening 45 but which is normally covered by the slidable slat 46. In closed inner position, the slat 46 will be beneath the downwardly-displaceable opening-forming disc 41 (FIG. 10).

If the container assembly is to receive certain materials, such as dry granular material, liquids or semi-liquids, it may be desirable to provide a liner in the form of a bag 47 which will be closed at its bottom and open at its upper end. This bag, as will later appear, will rest on the bottom of the container and will preferably be filled from the top while in that position, being held closed or sealed after filling by any suitable fastening means 48 at the top.

To ensure that all the contents of the container will flow therefrom through the central bottom opening 44, formed by displacing disc 41, there is provided, according to this invention, a false bottom of funnel-like form. This bottom consists of two sections only, namely, a lower upright support section 51 which is of polygonal form, corresponding in number of sides to the polygonal body 10 of the container, and a funnel-like material directing section 52, which has its upper wide-end supported and resting on the upper end of section 51 and converging to a narrow lower end having an opening 44*a* above the opening-forming disc 41 on the bottom disc 21. Both sections are supplied in knocked-down form and then inserted into the body 10.

The support section 51 will have the same number of hinged panels 11*a*, as the panels 11 of the body, but will be of slightly less perimeter size so it will be complemental to and slide axially within the body 10. The panels 11*a* are hinged together at 12*a*, corresponding to the hinges 12 of panels 11. Thus, panels 11*a* will be in upright flat contact with panels 11. The lower edges of panels 11*a* will rest on the corresponding inturned flanges 14 of panels 11. The upper edges of panels 11*a* are preferably provided with inturned support flanges 11*b* which help support material-directing section 52.

The section 52 is of funnel-like formation and consists of a number of triangular panels or material-directing wall sections 60 of triangular form which are hinged together at side hinges 61. They correspond in number to the hinged side panels 11 of the container body 10 and, consequently, in number to the hinged panels 11*a* of the support section 51. The triangular panels 60 are wide at their outer ends and narrower at their inner ends to produce the funnel shape of section 52 and are blunted at their inner ends so as to remove an amount of material sufficient to produce the lower dispensing outlet 44*a*. Thus, each wall or panel 60 is supported at its outer end by flange 11*d* and panel 11*a* and, therefore, complete perimeter support is provided. The lower edge of each panel 11*a* will rest on the flange 14 of corresponding panel 11 which will, in turn, be supported by bottom disc 21. The height of section 51 can be such as to make the inclination of the walls or panels 60 of section 52 to be greater than the angle of repose of the material the container body or receptacle 10 is intended to receive.

The funnel-like section 52 is formed from a square blank of fiberboard or similar material with little waste of material merely at the corners and at the center where the dispensing opening 44*a* is provided. As indicated in FIG. 4, the blank is cut to provide a disc with the central opening 44*a* and a radial slit 62 to provide adjacent radial edges. It is scored to provide the radially extending hinge lines 61 which are spaced apart to form a plurality of the panels or walls 60 of triangular form. The outer or wider straight and 64 of each wall is of substantially the same width as panel 11*a* of the support section 51 and panel 11 of the body 10. The forming of the central opening 44*a* by cutting a circular opening in the disc results in removal of a certain amount of material at the inner pointed end of each triangular panel 60 to provide an arcuate blunted inner end 63.

Figure 6:
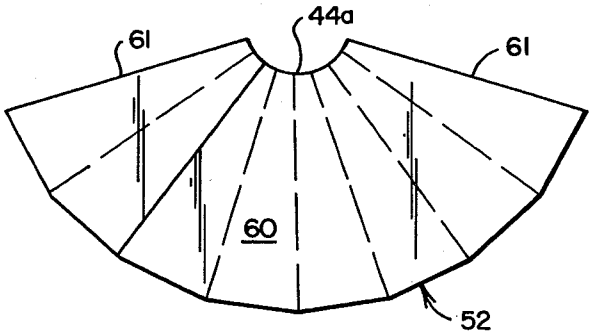
FIG. 6 is a plan view showing the folded section of FIG. 4.

The panels 60 of the blank are provided in a number greater than that of the panels 11 of the container body 10 in which the funnel-like bottom 50 is to fit. This provides for overlapping and securing together two or more of the panels 60 adjacent the respective edges of the radial slit 62 to provide a tapered or funnel section which will later be folded flat into a fan shape knocked-down section at two radially-opposed hinges 61, as indicated in FIG. 6, with superimposed layers each layer containing triangular panels 60 in one-half the number of panels 11 of the body 10, the total of the panels of the opposed two layers being equal to the number of panels 11. Thus, certain panels 60 adjacent the slit edges 62 will be of double thickness.

The support section 51 is formed from an elongated rectangular blank of fiberboard or similar material with little waste. By cutting and scoring, it is provided with the same number of rectangular panels 11*a*, as the panels 11 of the container body 10, hinged at score lines 12*a*. In addition, a securing flap 11*b* is hinged at one end at 11*c* for overlapping with the panel 11*a* at the opposite end. Each panel 11*a* has its one end, which will be its upper end in the container body, one of the flanges 11*d* hinged thereto at a transverse score line 12*d*. Notches 11*e* are provided between the flanges 11*d* to facilitate downward folding without interference with each other when section 51 is in the container body 10.

Figure 5:
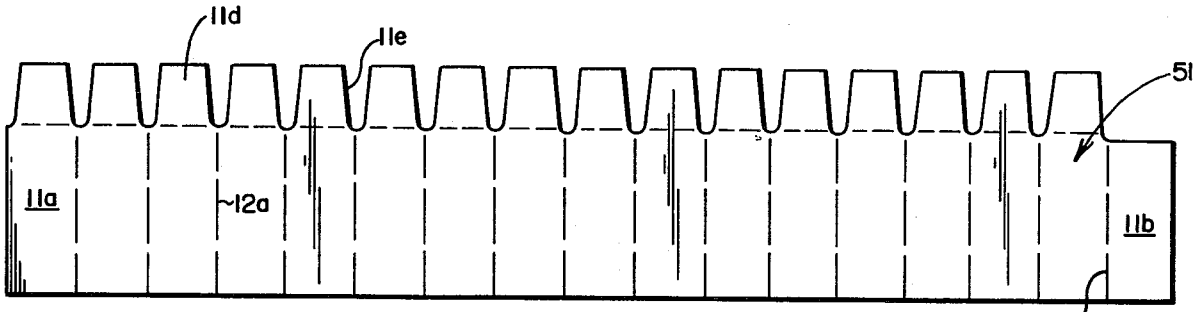
FIG. 5 is a plan view of the unfolded blank used in forming the support section of the funnel-like bottom.
Figure 7:
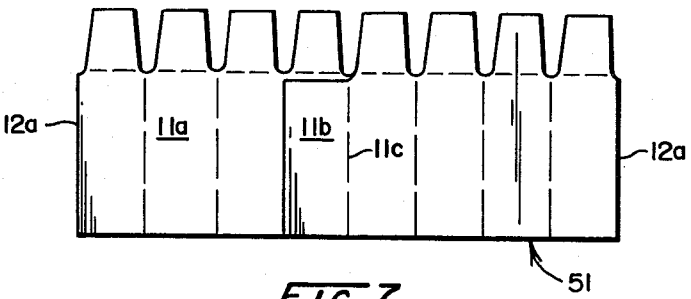
FIG. 7 is a plan view showing the folded section of FIG. 5.

The securing flap 11*b* of the blank of FIG. 5 is brought into overlapping relationship to the panel 11*a* at the other end and secured thereto. Then the blank is folded flat at two opposed hinge lines 12*a* to produce the knocked-down substantially rectangular flat section of FIG. 7 with two superimposed layers, each layer containing half the number of panels 11*a* as the number of panels 11 in container body 10, the total of the panels of the two layers being equal to the number of panels 11.

Figure 8:
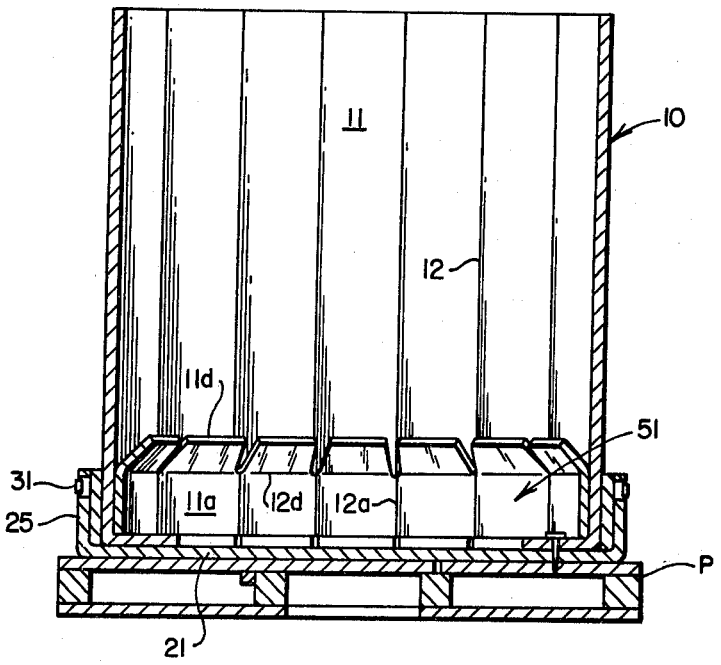
FIG. 8 is a vertical sectional view through the container showing the support section of the funnel-like bottom inserted therein.
Figure 9:
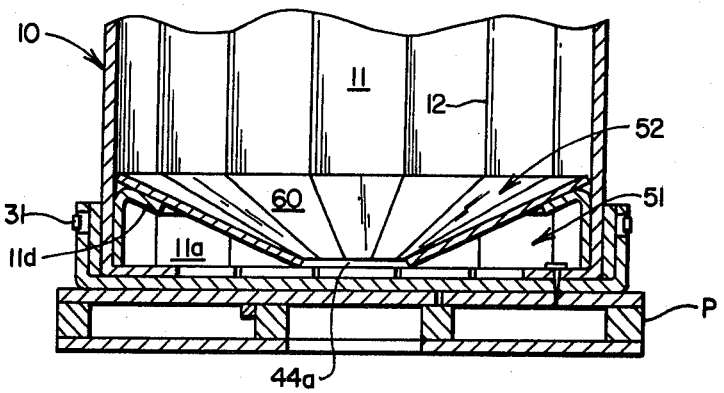
FIG. 9 is a similar view showing the material-directing section positioned on the support section.

Assuming the body 10 of the container is assembled on the bottom closure 20, as indicated in FIG. 8, the funnel-like bottom may be formed by successively inserting the sections 51 and 52, as indicated in FIGS. 8 and 9. The knocked-down folded bottom section blank of FIG. 7 will be unfolded and inserted in the body 10 with its panels 11*a* upright and in flat contact with the respective body panels 11. The lower edge of each panel 11*a* will rest on a support structure of the bottom which, in this instance, is a flange 14 but may be otherwise in different bottom structures. The upper support flanges 11*d* will be turned inwardly, at least slightly. Then, the blank of FIG. 6 is unfolded to provide the funnel-like section 52 and is inserted into the body 10 with its smaller end downwardly, as indicated in FIG. 9, bending the support flanges 11*d* further downwardly into inclined position and finally resting in firmly supported position with its material-directing triangular walls 60 inclining and converging downwardly into the opening 44*a*.

The opening 44*a* of section 52 will lie over the removable disc 41 in bottom disc 21 and the upper straight ends 64 of the triangular material-directing walls 60 will be in tight engagement with the inner surfaces of the upright panels 11 of the container body 10. The support flanges 11*d* will prevent the funnel-like section 52 from slipping down within the upright support section 51 although they are not necessary when using heavy materials.

Figure 12:
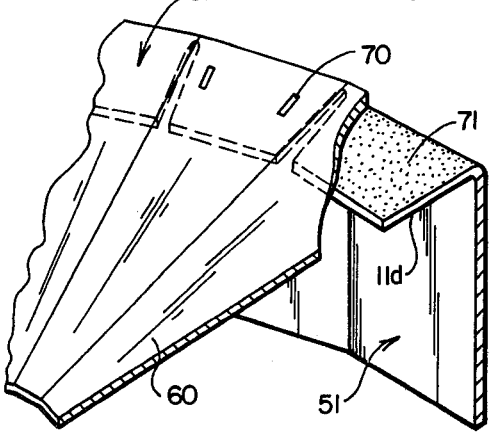
FIG. 12 is a partial perspective view, broken away, showing how the material-directing section and support section of the funnel-like bottom may be secured together before insertion into the container body.

Instead of positioning the sections 51 and 52 successively in the body 10 of the container, they could be secured together as a unit and then be inserted in the body. Thus, as shown in FIG. 12, the outer wider straight end 64 of each material-directing wall 60 of the section 52 could be secured by staples 70 or adhesive 71 to the support flanges 11*d* of unit 51. Then, the complete assembly could be inserted within the body 10 of the container and be properly positioned on the bottom thereof. The result will be a bottom which tapers downwardly towards the central opening 44 in disc 21 to feed the material towards that opening.

When the bag 47 is provided and filled, it rests on the bottom 50 and will seal the opening 44*a*, as shown in FIG. 10. A top closure 20*a* similar to the bottom closure 20 may be used. To dispense the contents of the bag, the disc 41 will be pulled downwardly, out of position to form opening 44, after the slidable slat 46 of the pallet P is moved to expose that disc. Then, the bottom of the bag 47 is ruptured, as indicated in FIG. 11 to permit the material to discharge through the aligning false bottom opening, 44*a* the opening 44 in flat bottom 21 provided by displacement of the disc 41, and opening 45 in the pallet P.

It will be apparent from the above, that this invention provides a bottom structure for a drum-like polygonal container of the type indicated which will ensure the effective discharge of all of the container contents. The bottom is comprised of only two pieces, a peripheral support piece which rests on a suitable support structure from the body of the container and a material-directing funnel section resting on the support section. Both sections are made of simple folded or knocked-down blanks which can be expeditiously set up and inserted in the container body. Complete peripheral support for the funnel section is provided by the support section so it can adequately support the material which is to be packed in the container.

Having thus described this invention what is claimed is:

1. A container assembly comprising a tubular body of fiberboard with a bottom structure at its lower end, said body being formed of side-wall forming panels extending upwardly at the periphery thereof and which said side-wall forming panels are hinged together at vertical hinge lines to form said body of selected polygonal horizontal cross-sectional form, said bottom structure including support means secured to said side-wall panels; said bottom structure also including a funnel-like assembly composed of two main parts consisting of a peripheral support section and a funnel-like material-directing section supported thereby, said support section being of tubular form complemental to that of said tubular body so as to fit therewithin and comprising a plurality of upright support panels hinged together at vertical hinge lines and said upright support panels are equal in number to the said side-wall panels and are disposed in flat contact with the respective said side-wall panels and having lower edges resting on said bottom support means, said funnel-like section comprising a plurality of substantially triangular panels equal in number to said side-wall panels and hinged together at radially-extending hinge lines having wide ends disposed outwardly at the respective body panels and resting on the respective upright support panels and being inclined downwardly to narrower inner ends at a downwardly-opening dispensing outlet, said two main parts being unattached to each other prior to when the triangular panels rest on the respective upright support panels.

2. A container assembly according to claim 1 in which said upright support panels have hinged support flanges at their upper ends upon which rest the wide ends of the respective triangular panels of the funnel-like section.

3. A container assembly according to claim 1 or 2 in which the bottom structure support means includes a tray-like closure of fiberboard having a flat bottom with a polygonal periphery having upstanding flanges hinged thereto which correspond in number and arrangement to said side-wall forming panels and extend upwardly along corresponding side-wall panels to which they are secured, said flat bottom having a displaceable portion to form a dispensing opening corresponding to the dispensing outlet of said funnel-like section.

4. A container assembly according to claim 3 in which a pallet is provided on which said flat bottom rests, said pallet having a support part normally supporting said displaceable portion but movable away from that supporting relationship.

5. A container assembly according to claim 3 in which the closure, tray-like container bottom, support section and funnel-like section each is supplied in flat knocked-down condition.

6. A container assembly according to claim 1 or 2 in which the support section is formed of the upright support panels hinged together adjacent side hinges and folded at opposed side hinges to provide a folded knocked-down blank in two superimposed layers of upright support panels, each layer consisting of one-half the side-wall forming panels of said body; and the funnel-like section is formed of the triangular panels which are greater in number than the side-wall forming panels of said body but with some of the triangular panels overlapped to provide the same number of triangular panels as the number of said side-wall forming panels, said funnel-like section being folded flat at opposed side hinges into knocked-down fan-like form.

7. A container assembly according to claim 6 in which each of the triangular panels has said outer wide end adapted to contact an inner surface of a side-wall forming panel and said narrow inner end to cooperate in forming said dispensing outlet.

* * * * *